US006612031B2

(12) United States Patent
Rhodes et al.

(10) Patent No.: US 6,612,031 B2
(45) Date of Patent: Sep. 2, 2003

(54) TUBE FOR A HEAT EXCHANGER AND METHOD OF MAKING SAME

(75) Inventors: Eugene E. Rhodes, Belleville, MI (US); Greg A. Whitlow, Whitmore Lake, MI (US); Wen Fei Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/206,623

(22) Filed: Jul. 26, 2002

(65) Prior Publication Data

US 2002/0184765 A1 Dec. 12, 2002

Related U.S. Application Data

(62) Division of application No. 09/684,236, filed on Oct. 6, 2000, now abandoned.

(51) Int. Cl.[7] ..... B23P 15/26
(52) U.S. Cl. ..... 29/890.053; 29/557; 29/558
(58) Field of Search ..... 29/890.053, 558, 29/557; 72/325; 83/54, 862

(56) References Cited

U.S. PATENT DOCUMENTS

| | | | | |
|---|---|---|---|---|
| 4,334,703 A | * | 6/1982 | Arthur et al. | 285/222 |
| 4,457,200 A | * | 7/1984 | Borzym | 83/862 |
| 4,657,069 A | | 4/1987 | Easton | |
| 4,794,684 A | | 1/1989 | Vanlauwe | |
| 4,819,586 A | | 4/1989 | Kreuter | |
| 4,825,941 A | | 5/1989 | Hoshino et al. | |
| 4,936,379 A | | 6/1990 | Hoshino et al. | |
| 5,025,855 A | | 6/1991 | Hoshino et al. | |
| 5,046,555 A | | 9/1991 | Nguyen | |
| 5,048,602 A | | 9/1991 | Motohashi et al. | |
| 5,052,479 A | | 10/1991 | Nakajima et al. | |
| 5,094,293 A | | 3/1992 | Shinmura | |
| 5,101,561 A | | 4/1992 | Fuhrmann et al. | |
| 5,101,887 A | | 4/1992 | Kado | |
| 5,127,154 A | | 7/1992 | Johnson et al. | |
| 5,172,761 A | | 12/1992 | Lyon | |
| 5,174,372 A | | 12/1992 | Potier et al. | |
| 5,186,244 A | | 2/1993 | Joshi | |
| 5,190,100 A | | 3/1993 | Hoshino et al. | |
| 5,237,899 A | * | 8/1993 | Schartinger | 83/454 |
| 5,246,064 A | | 9/1993 | Hoshino et al. | |
| 5,249,345 A | | 10/1993 | Virsik et al. | |
| 5,251,692 A | | 10/1993 | Haussmann | |
| 5,267,609 A | | 12/1993 | Olsson | |
| 5,275,236 A | | 1/1994 | Le Gauyer | |
| 5,299,636 A | | 4/1994 | Potier | |
| 5,301,748 A | | 4/1994 | Potier | |
| 5,318,114 A | | 6/1994 | Sasaki | |
| 5,343,620 A | | 9/1994 | Velluet | |
| 5,368,097 A | | 11/1994 | Chiba et al. | |
| 5,421,086 A | * | 6/1995 | Le Gauyer | 29/890.053 |
| 5,458,190 A | | 10/1995 | Sasaki et al. | |

(List continued on next page.)

FOREIGN PATENT DOCUMENTS

| | | |
|---|---|---|
| EP | 0 480 914 A2 | 7/1987 |
| JP | 58-221393 | 12/1983 |
| JP | 1-217195 | 8/1989 |
| JP | 7-251317 | 3/1995 |
| JP | 9-70711 | 3/1997 |
| JP | 2000-154995 | 6/2000 |
| WO | WO 97/27969 | 8/1997 |

*Primary Examiner*—I Cuda Rosenbaum
(74) *Attorney, Agent, or Firm*—Daniel J. Sepanik

(57) ABSTRACT

A tube and method of making the same for a heat exchanger includes a base, a top spaced from and opposing the base, a first side interposed between the base and the top along one side thereof, and a second side interposed between the base and the top along another side thereof. The tube includes an end form formed solely on either one of the first side and the second side to create a stop for inserting said tube into a manifold of the heat exchanger.

18 Claims, 4 Drawing Sheets

U.S. PATENT DOCUMENTS 5,460,026 A * 10/1995 Schafer ..... 72/55
5,538,076 A 7/1996 Nishida et al.
5,560,425 A 10/1996 Sugawara et al.
5,579,834 A 12/1996 Chiba
5,607,012 A 3/1997 Buchanan et al.
5,653,022 A 8/1997 Logic
5,737,952 A * 4/1998 Baumann et al. ..... 72/55
5,941,303 A 8/1999 Gowan et al.
5,979,051 A 11/1999 Kato et al.
6,012,513 A 1/2000 Iokawa et al.
6,026,569 A 2/2000 Evans et al.
6,216,776 B1 4/2001 Kobayashi et al.
6,357,327 B1 * 3/2002 Usui et al. ..... 83/319
6,439,089 B1 * 8/2002 Fasske ..... 83/13
2002/0029474 A1 * 3/2002 Mitsukawa et al. ..... 29/890.03

* cited by examiner

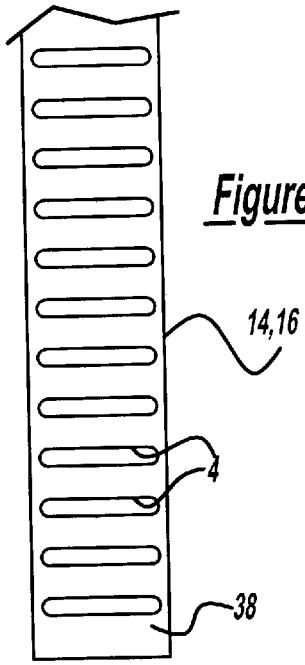
Figure - 2
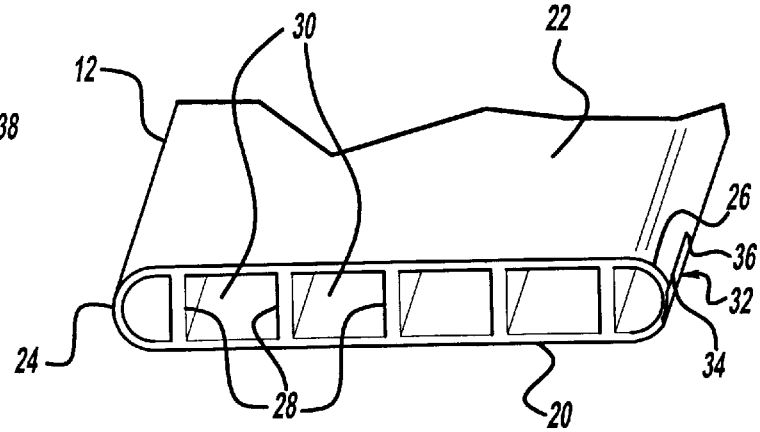
Figure - 3
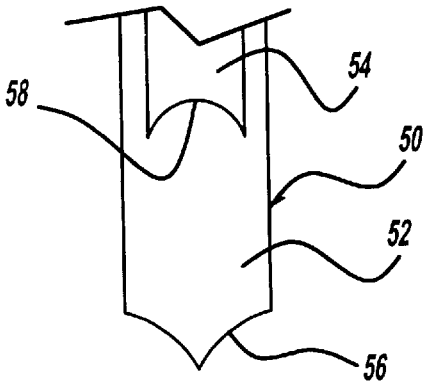
Figure - 4
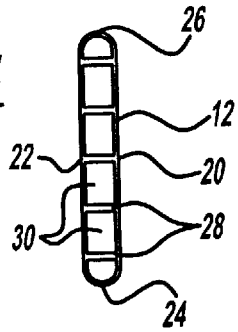

TUBE FOR A HEAT EXCHANGER AND METHOD OF MAKING SAME

CROSS-REFERENCE TO RELATED APPLICATION(S)

The present application is a divisional application of U.S. patent application Ser. No. 09/684,236, filed Oct. 6, 2000 abandoned.

BACKGROUND OF THE INVENTION

1. Field of the Invention

The present invention relates generally to heat exchangers for motor vehicles and, more specifically, to a tube and method for making same for a heat exchanger in a motor vehicle.

2. Description of the Related Art

It is known to provide a tube for a heat exchanger such as a condenser in an air conditioning system of a motor vehicle. The tube typically carries a first fluid medium in contact with its interior while a second fluid medium contacts its exterior. Typically, the first fluid medium is a liquid and the second fluid medium is air. Where a temperature difference exists between the first and second fluid mediums, heat will be transferred between the two via heat conductive walls of the tube.

It is also known to provide manifolds for the ends of the tubes. The manifolds have a plurality of slots spaced axially therealong to receive one end of the tubes. However, one disadvantage is that there is no consistency or predefined limit for inserting the end of the tube into the manifold.

One known method of making such a tube includes a secondary operation for forming an end of the tube with a shoulder that creates a stop for insertion of the tube into the manifold. The secondary operation may be a separate operation from the tube mill, or it may be an operation as part of the tube mill at the downstream for the tube making flow after the tube has been cut-off.

Although the above tubes have worked well, they suffer from the disadvantage that the tooling for the end forming, in general, is relatively expensive or costly. Another disadvantage of the above tubes is that a secondary operation is needed to form the end of the tubes. Therefore, there is a need in the art to provide a tube for a heat exchanger of a motor vehicle and method of making same that overcomes these disadvantages.

SUMMARY OF THE INVENTION

Accordingly, the present invention is a tube for a heat exchanger. The tube includes a base, a top spaced from and opposing the base, a first side interposed between the base and the top along one side thereof, and a second side interposed between the base and the top along another side thereof. The tube also includes an end form formed solely on either one of the first side and the second side to create a stop for inserting said tube into a manifold of the heat exchanger.

In addition, the present invention is a method of making a tube for a heat exchanger. The method includes the steps of forming a tube having a base and a top opposing the base and a first side interposed between the top and the base and a second side interposed between the top and the base. The method includes the step of cutting the tube to form an end thereon and forming an end form on only one side of the tube to create a stop for inserting the tube into a manifold of the heat exchanger.

One advantage of the present invention is that a tube for a heat exchanger such as a condenser is provided with an end form for insertion in a manifold of the heat exchanger for an air conditioning system of a motor vehicle for condensing liquid refrigerant. Another advantage of the present invention is that a method is provided of making the tube with an end form that eliminates secondary operation for the end form. Yet another advantage of the present invention is that the tube is cut-off and end formed in a single station to save tube-manufacturing cost. Still another advantage of the present invention is that the tube eliminates tooling for a secondary operation, making the tube with an end form relatively inexpensive to manufacture.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 2 is a partial side elevational view of a manifold for the heat exchanger of FIG. 1.

FIG. 3 is a partial perspective view of an end view of the tube of FIG. 1.

FIG. 4 is an elevational view of a cut-off and end forming tool for cutting off and forming the end of the tube in FIG. 3.

DESCRIPTION OF THE PREFERRED EMBODIMENT(S)

Figure 1:
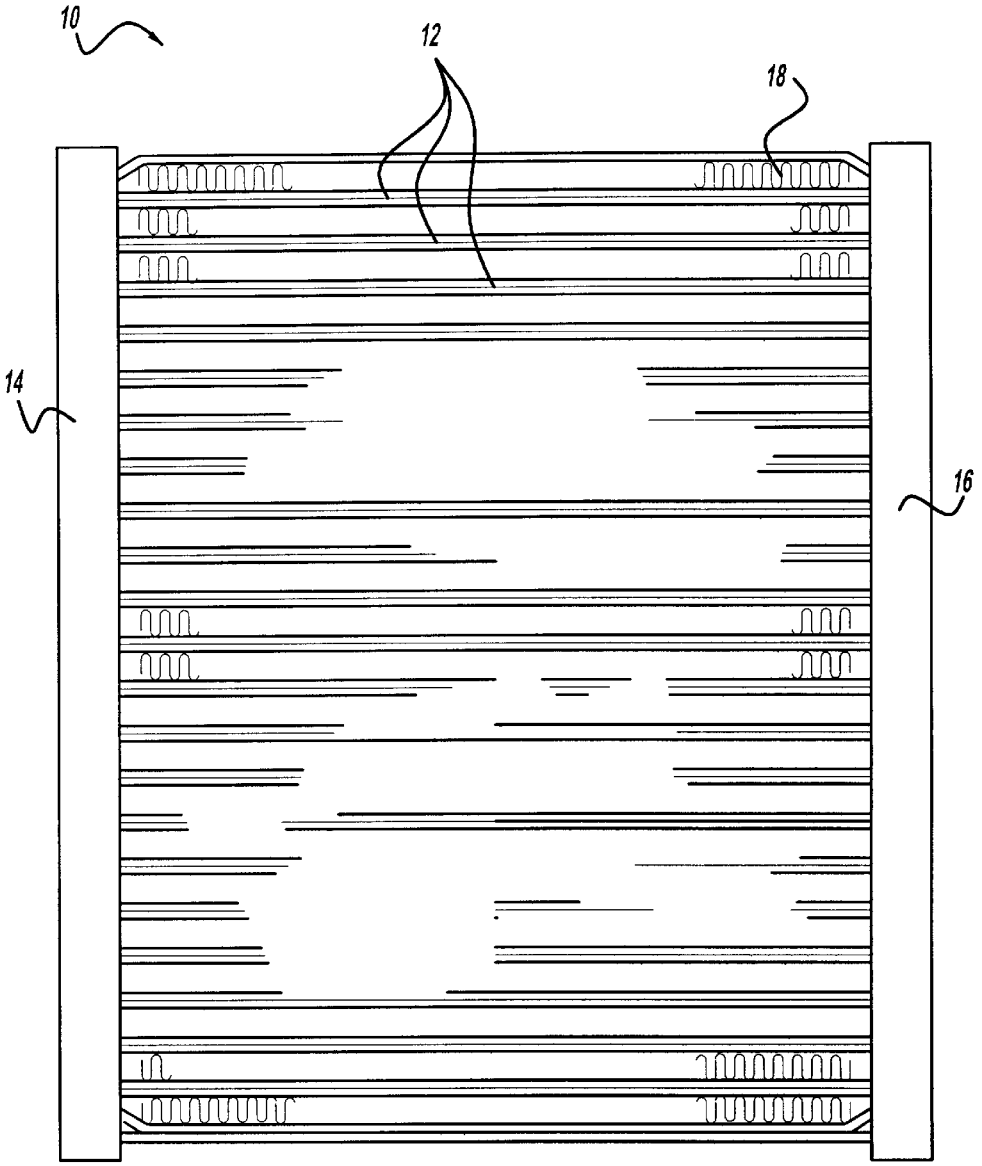
FIG. 1 is an elevational view of a tube, according to the present invention, illustrated in operational relationship with a heat exchanger of a motor vehicle.

Referring to the drawings and in particular FIG. 1, one embodiment of a heat exchanger 10, such as a condenser for an air conditioning system (not shown), is shown for a motor vehicle (not shown). The heat exchanger 10 includes a plurality of generally parallel tubes 12, according to the present invention, extending between oppositely disposed headers or manifolds 14,16. The heat exchanger 10 includes a fluid inlet (not shown) for conducting cooling fluid into the heat exchanger 10 formed in the manifold 14 and an outlet (not shown) for directing cooling fluid out the heat exchanger 10 formed in the manifold 16. The heat exchanger 10 also includes a plurality of convoluted or serpentine fins 18 attached to an exterior of each of the tubes 12. The fins 18 are disposed between each of the tubes 12. The fins 18 conduct heat away from the tubes 12 while providing additional surface area for convective heat transfer by air flowing over the heat exchanger 10. It should be appreciated that, except for the tube 12, the heat exchanger 10 is conventional and known in the art. It should also be appreciated that the tube 12 could be used for heat exchanges in other applications besides motor vehicles.

Figure 8:
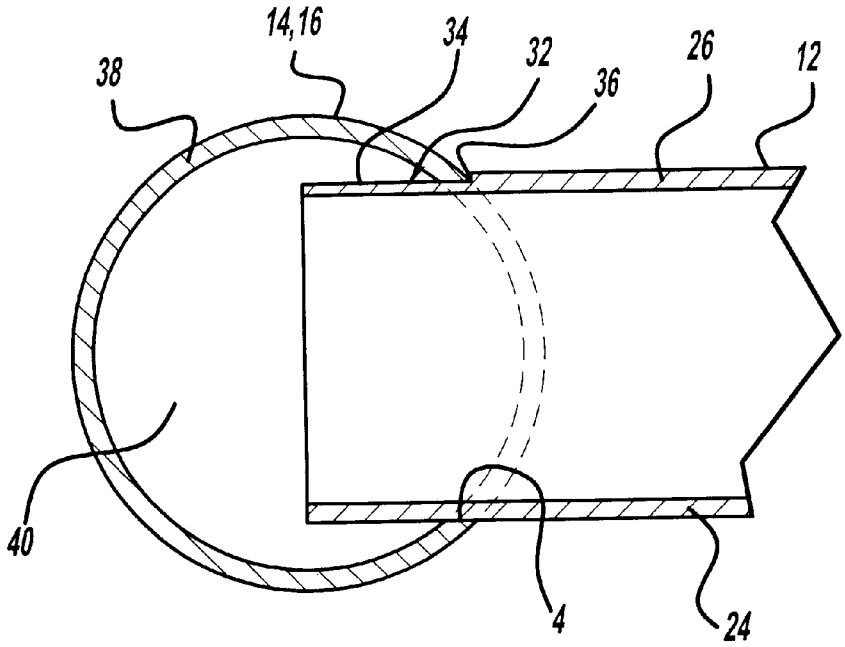
FIG. 8 is a fragmentary plan view of the tube and manifold of the heat exchanger of FIG. 1.

Referring to FIGS. 2, 4, and 8, folded tube 12 extends longitudinally and is substantially flat. The folded tube 12 includes a base 20 being generally planar and extending laterally. The tube 12 also includes a top 22 spaced from the base 20 a predetermined distance and opposing each other. The top 22 is generally planar and extends laterally. The tube 12 includes a first side 24 interposed between the base 20 and the top 22 along one side thereof. The first side 24 is generally arcuate in shape. The tube 12 also includes a second side 26 interposed between the base 20 and the top 22 along the other side and opposing the first side 24. The tube 12 may include at least one, preferably a plurality of internal webs 28 extending from either one of or both the base 20 and top 22 to form a plurality of ports or flow paths 30 in the interior of the tube 12. The tube 12 is made of a metal material such as aluminum. The tube 12 has a generally rectangular cross-sectional shape. It should be appreciated that the tube 12 may have any suitable cross-sectional shape.

Referring to FIGS. 3 and 8, the first side 24 is generally arcuate in shape. The second side 26 is generally arcuate in shape and has an end form, generally indicated at 32, formed on the end thereof. The end form 32 has a recess 34 extending inwardly and a shoulder 36 at the end of the recess 34 that acts as a stop. The recess 34 extends axially a predetermined distance and a predetermined depth.

Either one or both of the manifolds 14 and 16 extend axially and have a generally circular cross-sectional shape. The manifolds 14 and 16 have a side 38 extending axially to form an interior chamber 40. The side 38 has a plurality of slots 42 extending therethrough and spaced axially to receive one end of the tubes 12. The slots 42 are generally rectangular in shape and have a width less than a width of the tubes 12. The recess 34 of the end form 32 allows the end of the tubes 12 to be inserted through the slots 42 and into the interior chamber 40 until the shoulder 36 abuts or contacts the side 38. It should be appreciated that the tubes 12 are secured to the side 38 by suitable means such as brazing. It should also be appreciated that the end form 32 may be formed on the first side 24 or the second side 26, but is formed on only one of the sides 24 and 26 of the tube 12.

Referring to FIGS. 4 through 7, a method, according to the present invention, of the making the tube 12 is shown. The method includes the steps of providing or forming the tube 12 with the base 20, top 22, first side 24, and second side 26. The tube 12 may be formed by extrusion in a relatively long strip in a tube mill (not shown). Once the tube 12 is formed, it advances to a single station (not shown) to be cut-off and end formed by a cut-off and end forming tool, generally indicated at 50, as illustrated in FIG. 4. The cut-off and end forming tool 50 includes a cut-off blade 52 and an offset block 54 affixed to the cut-off blade 52. The cut-off blade 52 has a leading edge 56 to cut the tube 12 using a single stroke. The offset block 54 has a generally arcuate edge 58 spaced axially from the leading edge 56 of the cut-off blade 52 to strike the side 26 and form the recess 34 and shoulder 36 of the end form 32. It should be appreciated that the cut-off and end forming tool 50 is connected to a reciprocating actuator (not shown), which is conventional and known in the art.

Figure 5:
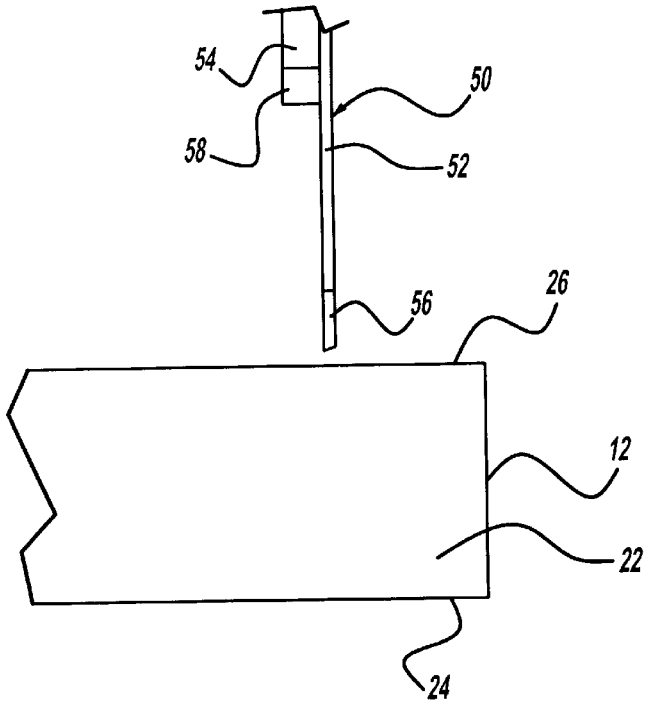
FIG. 5 is an elevational view of the cut-off and end forming tool of FIG. 4 illustrating a first stage of operation.
Figure 6:
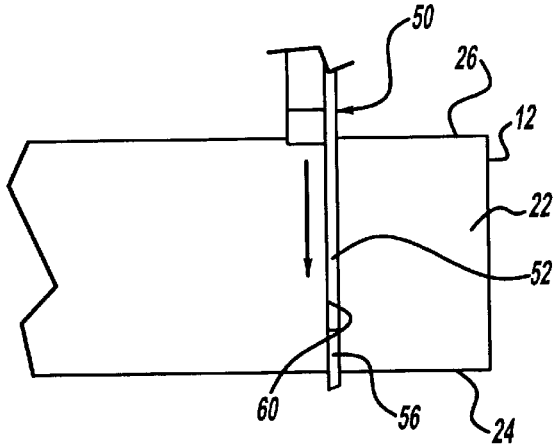
FIG. 6 is a view similar to FIG. 5 illustrating a second stage of operation.
Figure 7:
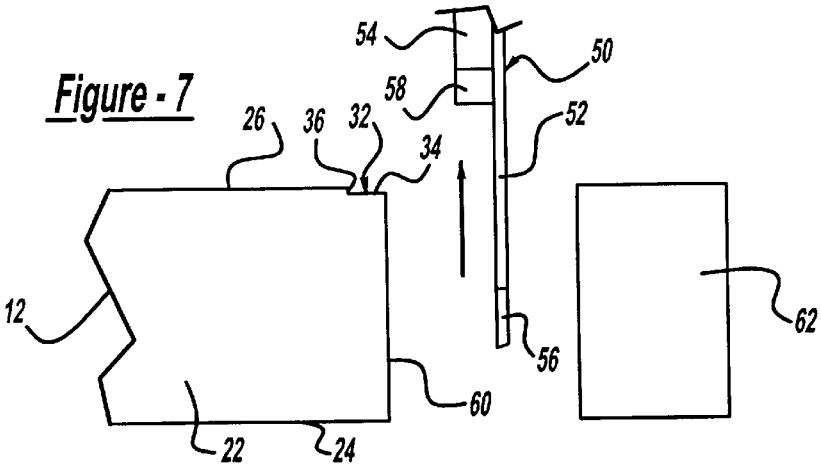
FIG. 7 is a view similar to FIG. 5 illustrating a third stage of operation.

The method includes the step of orientating the tube 12 so that it rests on the first side 24 and the second side 26 fates the cut-off and end forming tool 50. The method includes the step of moving the cut-off and end forming tool 50 toward the second side 24 to contact the tube 12 as illustrated in FIG. 5. The method includes the step of cutting the tube 12 with the leading edge 56 of the cut-off blade 52 using a single stroke to cut-off and form an end 60 of the tube 12 as illustrated in FIG. 6. At the bottom of the single stroke, that is, when the cut-off blade 52 is finished cutting the tube 12 completely, but the cut-off blade 52 is still moving downward, the method includes the step of contacting the second side 24 with the off-set block 54 and forming the end form 32 as illustrated in FIG. 7. The cut-off and end forming tool 50 is retracted and the recess 34 and shoulder 36 of the end form 32 has been formed and a scrap 62 of the tube 12 has been formed which falls away as illustrated in FIG. 7.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of making a tube for a heat exchanger comprising the steps of:

forming a tube having a base and a top opposing the base and a first side interposed between the top and the base and a second side interposed between the top and the base; and cutting the tube and forming an end form on only one side of the tube in a single stroke to create a stop for inserting the tube into a manifold of the heat exchanger.

2. A method as set forth in claim 1 including the step of providing a cut-off and end forming tool to cut the tube and form the end form.

3. A method as set forth in claim 2 including the step of orientating either the first side or the second side toward the cut-off and end forming tool.

4. A method as set forth in claim 2 including the step of providing the cut-off and end forming tool with a cut-off blade having a leading edge and an off-set block having an end forming edge spaced axially from the leading edge.

5. A method as set forth in claim 4 including the step of cutting the tube with the leading edge of the cut-off blade to form the end on the tube.

6. A method as set forth in claim 4 including the step of moving the cut-off blade downwardly and contacting the tube with the end forming edge of the off-set block.

7. A method as set forth in claim 4 including the step of forming a recess in the tube with the end forming edge of the off-set block and a shoulder at the end of the recess to form the end form.

8. A method as set forth in claim 7 wherein the recess has an axial length equal to an axial depth of the off-set block.

9. A method of making a tube for a heat exchanger comprising the steps of:

forming a tube;

providing a cut-off and end forming tool with a cut-off blade and an off-set block; and cutting the tube and forming an end form on only one side of the tube in a single stroke to create a stop for inserting the tube into a manifold of the heat exchanger.

10. A method as set forth in claim 9 including the step of orientating a side of the tube toward the cut-off and end forming tool.

11. A method as set forth in claim 9 including the step of cutting the tube with the cut-off blade to form the end on the tube.

12. A method as set forth in claim 9 including the step of moving the cut-off blade downwardly and contacting the tube with the off-set block.

13. A method as set forth in claim 9 including the step of forming a recess in the tube with the off-set block and a shoulder at the end of the recess to form the end form.

14. A method as set forth in claim 13 wherein the recess has an axial length equal to an axial depth of the off-set block.

15. A method of making a tube for a heat exchanger comprising the steps of:

forming a tub having a base and a top opposing the base and a first side interposed between the top an the base and a second side interposed between the top and the base;

providing a cut-off and end forming tool with a cut-off blade and an off-set block;

moving the cut-off blade downwardly and contacting the tube with the off-set block; and cutting the tub with the cut-off blade and forming an end form on only one side of the tube in a single stroke create a stop for inserting the tube into a manifold of the heat exchanger.

16. A method as set forth in claim 15 including the step of orientating either the first side or the second side toward the cut-off and end forming tool.

17. A method as set forth in claim 15 including the step of forming a recess in the tube with the off-set block and a shoulder at the end of the recess to form the end form.

18. A method as set forth in claim 17 wherein the recess has an axial length equal to an axial depth of the off-set block.

* * * * *